US007270387B2

(12) United States Patent
Ueda et al.

(10) Patent No.: US 7,270,387 B2
(45) Date of Patent: Sep. 18, 2007

(54) RECORDING HEAD POSITION ADJUSTING STRUCTURE AND INKJET PRINTER PROVIDED WITH SAID ADJUSTING STRUCTURE

(75) Inventors: Masato Ueda, Akishima (JP); Naoki Otomo, Otsuki (JP); Yasuhiro Matsui, Hachioji (JP)

(73) Assignee: Konica Minolta Holdings Inc., Tokyo (JP)

( * ) Notice: Subject to any disclaimer, the term of this patent is extended or adjusted under 35 U.S.C. 154(b) by 319 days.

(21) Appl. No.: 11/041,039

(22) Filed: Jan. 21, 2005

(65) Prior Publication Data

US 2005/0168514 A1 Aug. 4, 2005

(30) Foreign Application Priority Data

Jan. 30, 2004 (JP) ..... 2004-023375
Feb. 3, 2004 (JP) ..... 2004-026819

(51) Int. Cl.
*B41J 25/308* (2006.01)
*B41J 23/00* (2006.01)

(52) U.S. Cl. ..... 347/8; 347/37

(58) Field of Classification Search ..... 347/8, 347/37, 13, 42, 43; 400/55–60
See application file for complete search history.

(56) References Cited

FOREIGN PATENT DOCUMENTS

JP 3-76834 12/1991
JP 2001-113679 A * 4/2001

* cited by examiner

*Primary Examiner*—Shih-Wen Hsieh
(74) *Attorney, Agent, or Firm*—Frishauf, Holtz, Goodman & Chick, P.C.

(57) ABSTRACT

A position adjusting structure for adjusting a position of a recording head with respect to a recording head mounting portion of a printer main body, the position adjusting structure including: a head mounting plane arranged on the recording head mounting portion; an adjusting member, which is transferable along a direction substantially perpendicular to the head mounting plane; and an inclined flat plane, which is arranged on either one of the recording head mounting portion or the adjusting member and is inclined against the head mounting plane; wherein, the adjusting member transfers the position of the recording head with respect to the recording head mounting portion according with transfer of the adjusting member.

20 Claims, 8 Drawing Sheets

RECORDING HEAD POSITION ADJUSTING STRUCTURE AND INKJET PRINTER PROVIDED WITH SAID ADJUSTING STRUCTURE

BACKGROUND OF THE INVENTION

The present invention relates to a recording head position adjusting structure which adjusts the position of a recording head against a recording head mounting portion of a printer main body. Further, the present invention relates to an inkjet printer provided with a mechanism to perform position adjustment of the recording head.

Heretofore, an inkjet printer, which forms an image on a recording medium by ejecting ink onto the recording medium by use of a recording head, has been brought into practical use. To easily mount a recording head on an inkjet printer main body or to replace a recording head having finished the life by a new one, a recording head is mounted on a printer main body by means of assembly and a recording head is provided on a printer main body freely removable.

When a recording head is not mounted at an appropriate position, image displacement or a fuzzy image may be caused. Therefore, to mount a recording head at an appropriate position is important for excellent image formation.

For example in patent literature 1, described is a recording head position adjusting mechanism which adjusts the recording head position against a carriage of a printer main body. In this position adjusting mechanism, a recording head is mounted on the flat plane of a carriage and a plane inclined against said flat plane of the carriage is provided on this recording head. A screw, the head of which is press contacted with the inclined plane, is engaged to the flat plane of a carriage. When a screw is rotated to one direction by a user, the head of the screw is transferred to the direction of approaching to the flat plane of a carriage to press the inclined plane of a recording head, resulting in transferring the recording head along the flat plane toward the direction leaving from the screw. On the other hand, when a screw is rotated to the reverse direction by a user, the head of the screw is transferred toward the direction leaving from the flat plane of the carriage, resulting in enabling to transfer the recording head along the flat plane toward the direction approaching to the screw.

[Patent literature 1] JP-A No. 2001-113679 (Hereinafter, JP-A refers to Japanese Patent Publication Open to Public Inspection)

However, dimensions such as the position and inclined angle of the inclined plane may be varied due to errors depending on individual recording heads, which requires more precise design and manufacturing of a recording head to avoid dimensional errors of the inclined plane. Further, without performing precise design and manufacturing of a recording head, it is necessary to confirm the dimensional errors of the inclined plane to mount the recording head at an appropriate position; however, it is not easy to confirm the dimensional errors of the inclined plane.

Therefore, this invention has been made to solve the above problem and an objective of this invention is to provide a head position adjusting structure which permits mounting of a recording head at the appropriate position even without performing precise designing and manufacturing of a recording head.

Further, many inkjet printers have been utilized because they, generally, generate relatively small noises at the time of image recording and exhibit excellent image recording quality. As the aforesaid inkjet printer, there is, for example, a serial type in which a carriage, on which a plural number of recording heads are mounted along the main scan direction perpendicular to the transport direction of a recording medium, is transferred along said main scan direction and an image is formed by ejecting ink through the nozzles of recording heads while said carriage is transferred. Further, in recent years, proposed has been an inkjet printer which performs high speed and high quality image recording by arranging plural number of recording heads for ejection of each color ink.

To perform high precision image recording with such a serial type inkjet printer, it is necessary to accurately eject ink from the aforesaid plural number of recording heads while transferring the aforesaid carriage, which requires precise position adjustment between each recoding head. In particular, in the case of plural recording heads, which eject the same color ink, being provided and image recording is performed by regarding the plural recording heads, which eject the same color ink, as purely one recording head, there is a problem that generated is such as color unevenness, in which a certain portion is deep colored and another portion is light colored in a recorded image, resulting in difficulty of performing high precision image recording, when the nozzle positions do not coincide due to a position deviation between recording heads. Therefore, it is necessary to perform very precise adjustment as minute as ± few μm with respect to the position along the transfer direction of each recording head, which ejects the same color ink, so as to precisely adjust each recording head position to make the nozzle positions coincide.

With respect to this point, conventionally known has been an inkjet printer in which the positions along the main scan direction and transfer direction are adjusted by two adjusting screws from different directions being press contacted with a recording head and the pressing power against the recording head is adjusted by rotating each adjusting screw (for example, refer to patent literature 2).

[Patent literature 2] Japanese Patent Publication No. 3-76834

However, in the case of adjusting the positions of a recording head along the main scan direction and transport direction by use of two screws, since the position along the main scan direction having been determined in advance may be shifted at the time of successively determining the position along the transport direction even when the position along the main scan direction has been once determined, it is necessary to repeat minute adjustment many times to accurately determine the positions along both of the main scan and transport directions, resulting in a problem of tediousness.

Further, in the case of position adjustment is performed by a screw, the precision of adjustment is limited by the pitch of a screw groove formed on the circumferential surface of a screw. It is necessary to utilize a small screw to perform more precise adjustment, because the smaller is a screw, the more minute is the pitch of a screw groove. However, there is a problem that the thickness of a screw becomes slim as an adjustment screw becomes the smaller, resulting in being impossible of maintaining the strength as well as difficult operation for a user who performs adjustment action of the recording head.

Therefore, the present invention has been made to solve the above problem, and an objective of this invention is to provide an inkjet printer which enables to perform easy and accurate position adjustment of a recording head even in the case of employing a plural number of recording heads for the same color.

SUMMARY OF THE INVENTION

An aspect of the invention to solve the above-described problem is a position adjusting structure for adjusting a position of a recording head with respect to a recording head mounting portion of a printer main body, the position adjusting structure including: a head mounting plane arranged on the recording head mounting portion; an adjusting member, which is transferable along a direction substantially perpendicular to the head mounting plane; and an inclined flat plane, which is arranged on either one of the recording head mounting portion or the adjusting member and is inclined against the head mounting plane; wherein, the adjusting member transfers the position of the recording head with respect to the recording head mounting portion according with transfer of the adjusting member.

Another aspect of the invention is the position adjusting structure described above, wherein the inclined flat plane is arranged on the recording head mounting portion with inclined state against the head mounting plane, the inclined flat plane being inclined against a plane provided on the recording head, wherein the adjusting member contacts with the plane provided on the recording head and with the inclined flat plane.

DETAILED DESCRIPTION OF THE PREFERRED EMBODIMENT

Embodiment 1

In the following, the most preferred embodiment to perform this invention will be explained referring to drawings. Herein, the following embodiments include various limitations which are technically preferable to perform this invention; however, the scope of this invention is not limited to the following embodiments and illustrated examples.

Figure 1:
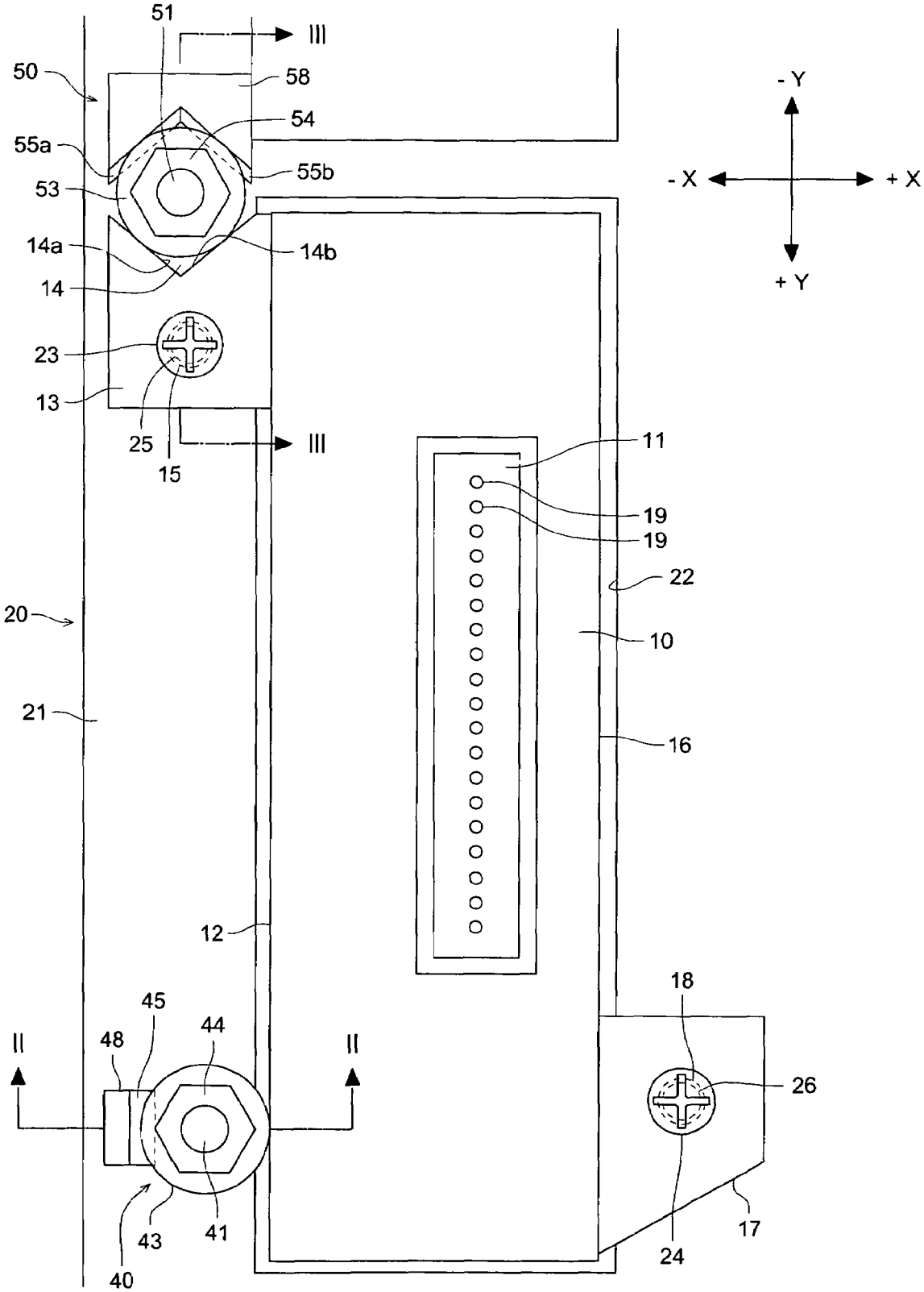
FIG. 1 is a plan view of recording head 10.
Figure 2:
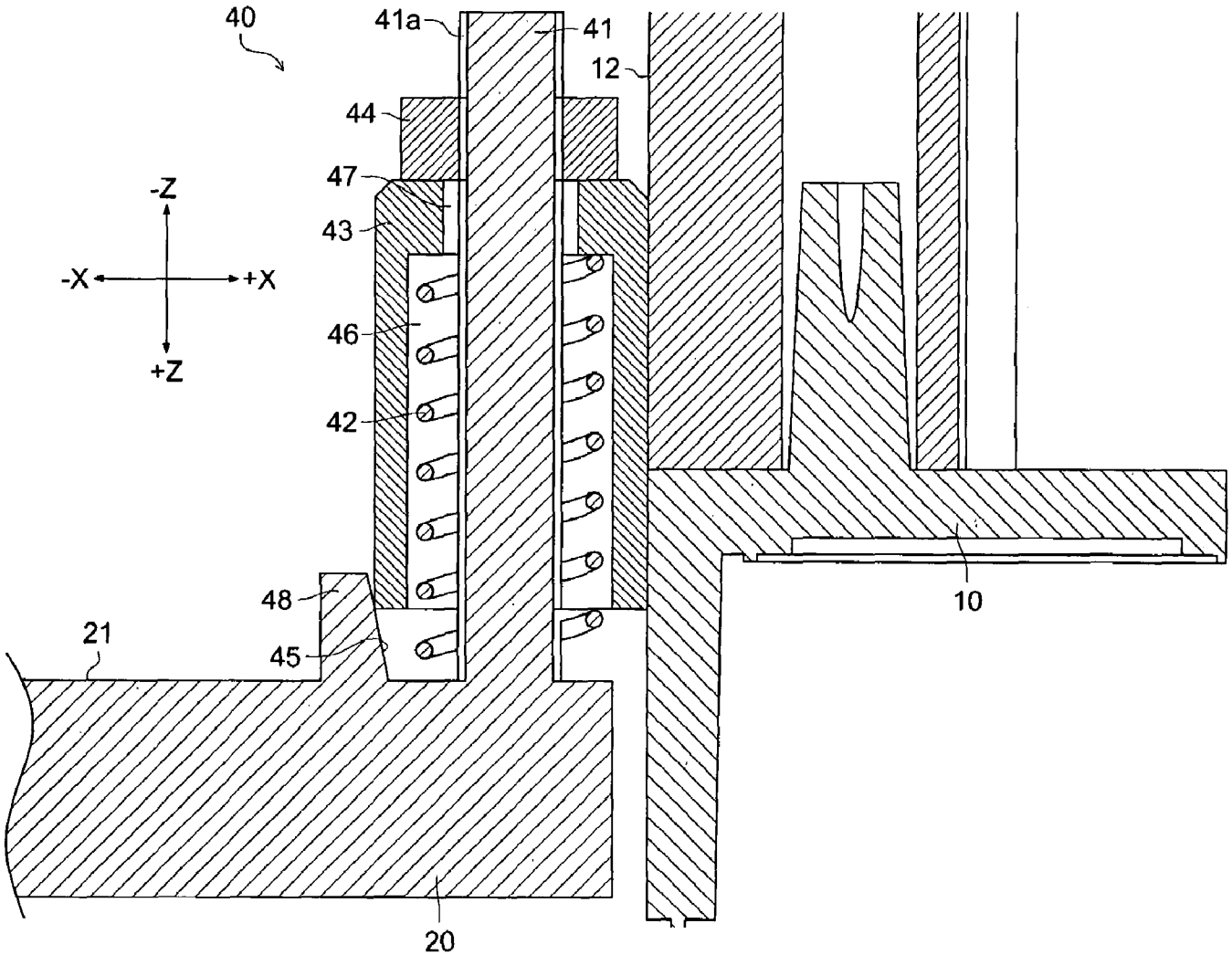
FIG. 2 is a cross-sectional view taken on plane II-II of FIG. 1.
Figure 3:
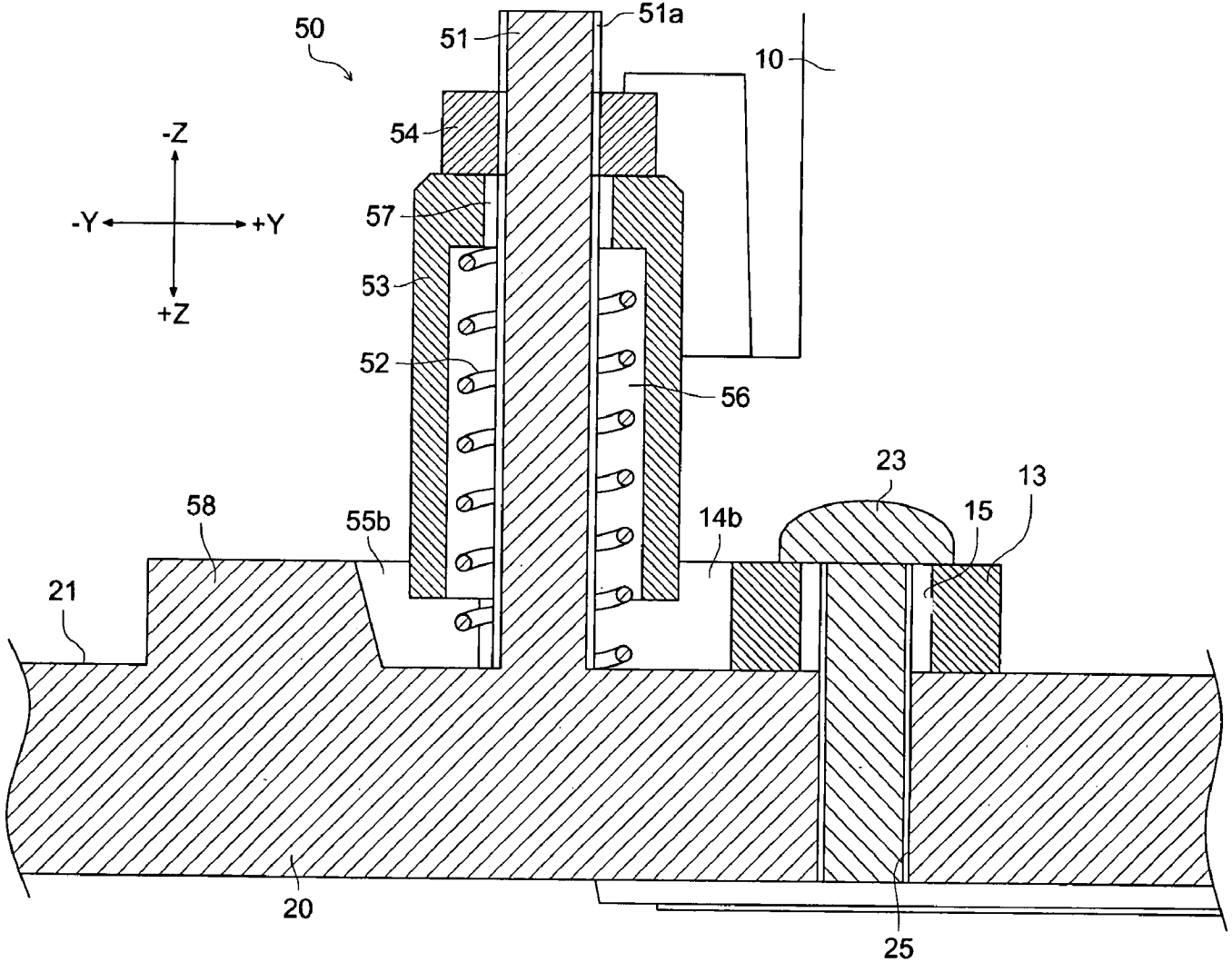
FIG. 3 is a cross-sectional view taken on plane III-III of FIG. 1.
Figure 4:
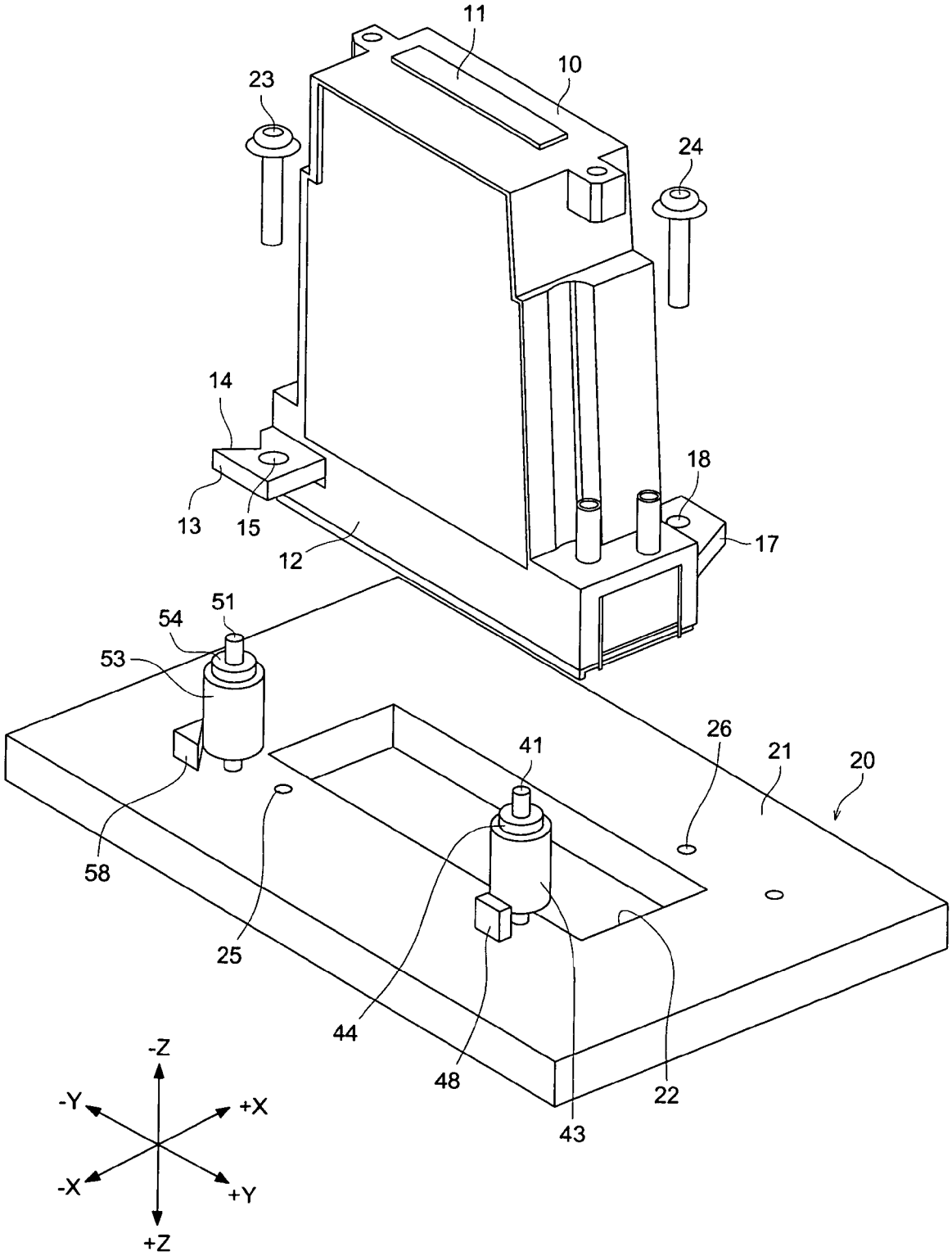
FIG. 4 is a perspective view of recording head 10 and carriage 20.

FIG. 1 is a plan view of recording head 10 and the surroundings, FIG. 2 is a cross-sectional view taken on plane II-II of FIG. 1, FIG. 3 is a cross-sectional view taken on plane III-III of FIG. 1, and FIG. 4 is a perspective view of recording head 10 and carriage 20.

An inkjet printer main body is equipped with carriage 20 as a recording head mounting portion on which a plural number of recording heads 10 are mounted, and bottom plane 21 of carriage 20 constitutes the mounting plane on which recording head 10 is mounted. Carriage 20 arranged so as to be transferable back and forth along the direction perpendicular to the recording medium transfer direction. Mounting plane 21 of carriage 20 is provided with a plural number of attaching holes 22 being formed to have a rectangular shape, and recording head 10 is attached to attaching hole 22 with clearance.

Herein the normal line direction of mounting plane 21 of carriage 20 (the direction being headed for by mounting plane 21 of carriage 20) is defined as the −Z direction, the opposite direction of −Z is defined as the +Z direction, one of the longitudinal direction of attaching hole 22 is defined as the +Y direction, the opposite direction of the +Y is defined as the −Y direction, one of the direction crossing the +Y direction and the +Z direction at right angles is defined as the +X direction, and the other direction crossing the +Y direction and the +Z direction at right angles is defined as the −X direction. When the XYZ directions are defined as described above, the recording medium transport direction is the +Y direction, the direction opposite to the recording medium transport direction is the −Y direction, the direction along which carriage 20 moves forth is the +X direction and the direction along which carriage 20 moves back is the −X direction.

Recording head 10 is constituted so as to make the length along the +Y direction and the height along the +Z direction to be longer than the width along the +X direction. A plural number of ejection outlets 19 are arranged along the +Y direction on bottom plane 11 of recording head 10. Recording head 10 is arranged so as to eject ink through these ejection outlets. Side surface 12 of recording head 10 facing to the −X direction is provided on recording head 10 as an outer surface of recording head 10. When recording head 10 is attached to attaching hole 22, side surface 12 of recording head 10 is arranged perpendicular to mounting plane 21 of recording head 20, parallel to the ±Z direction and the ±Y direction, and crossing the ±X direction at right angles.

Next, a fixing structure to fix recording head 10 to carriage 20 will be explained.

At the corner of the +Z direction and the −Y direction on side surface 12 of recording head 10, plate-formed fixing part 13 parallel to mounting plane 21 of carriage 20 is provided as one body with recording head 10. When fixing part 13 is viewed toward the +Z direction, V-shaped cut 14 is formed at the end portion in the −Y direction side of fixing part 13, and both side surfaces 14*a* and 14*b* of cut 14 are also provided on recording head 10 as outer surfaces of recording head 10. Both side surfaces 14*a* and 14*b* cross mounting plane 21 of carriage 20 at right angles.

Further, hole 15 is formed penetrating fixing part 13 in the ±Z direction, and screw 23 is inserted into this hole 13. This screw 23 is engaged with a screw hole 25 which is formed on mounting plane 21 of carriage 20. The diameter of hole 15 is not larger than the diameter of the head of screw 23 but not smaller than the diameter of a shaft portion of screw 23 (a portion on which a screw is cut). Therefore, recording head 10 can be transferred along the XY plane by as much as the clearance between the shaft portion of screw 23 and hole 15 when screw 23 is loosened, even in a state of screw 23 being engaged with screw hole 25. While, fixing part 13 is sandwiched between the head of screw 23 and mounting plane 21 of carriage 20 when screw 23 is tightened, which enables to fix recording head 10 against carriage 20.

At the corner of the +Z direction and the +Y direction in side surface 16 opposite to side surface 12, plate-formed fixing part 17 parallel to mounting plane 21 of carriage 20 is provided as one body with recording head 10. Hole 18 is formed penetrating fixing part 17 in the ±Z direction, and screw 24 is inserted into this hole 18 to be engaged with screw hole 26 formed on mounting plane of carriage 20. The diameter of the head of screw 24 is not smaller than the diameter of hole 18, while the diameter of a shaft portion of screw 23 is not larger than the diameter of hole 18, which provides clearance between the shaft portion of screw 24 and hole 18.

Next, an X direction position adjusting structure in an embodiment, to which a recording head position adjusting structure of this invention is applied, will be explained. This X direction position adjusting structure 40 adjusts the position of recording head 10 along the ±X direction by transferring recording head 10 along the ±X direction.

X direction position adjusting structure 40 is constituted of screw shaft portion 41 which is provided on mounting plane 21 in a state of parallel to side surface 12 of recording head 10 and standing against mounting plane 21 of carriage 20; coil spring 42 which is installed winding around screw shaft portion 41; adjusting member 43 which is formed in a cylindrical form, storing coil spring 42 in the hollow, being inserted with screw shaft portion 41 with clearance, and line contacts against side surface 12 of recording head 10 with its circumferential surface; inclined plane 45 which inclines against side surface 12 of recording head 10 and contacts with the edge of adjusting member 43; and nut 44 engaged with screw shaft portion 41 on the opposite side to inclined plane 45 relative to adjusting member 43.

Screw shaft portion 41 is constituted as one body with carriage 20 in the −X direction side than the attaching point of recording head 10. This screw shaft portion 41 is arranged perpendicular to mounting plane 21 of carriage 20, and the center line of screw shaft portion 41 is parallel to the ±Z direction. Screw groove 41*a* is provided on the outer circumferential surface of screw shaft portion 41 to form a bolt. Herein, screw shaft portion 41 may be provided as a separate body from carriage 20 and screw shaft portion 41 may be fixed against carriage 20 instead of arranging screw shaft portion 41 as one body with carriage 20.

Coil spring 42 is attached to wind around this screw shaft portion 41. The winding diameter of coil spring 42 is set to be larger than the diameter of screw shaft portion 41 to make clearance between coil spring 42 and screw shaft portion 41. Coil spring 42 is arranged freely against both screw shaft portion 41 and carriage 20, and fixed to neither screw shaft portion 41 nor carriage 20.

Further, screw shaft portion 41 is inserted into the hollow of adjusting member 43. Adjusting member 43 is formed so as to make the outside edge shape along the plane parallel to mounting plane 21 of carriage 20 to be circular, and further formed as a cylindrical form to provide a ring-shaped cross section perpendicular to the center line of screw shaft 41. The hollow of adjusting member 43 is constituted of large column hollow 46 on mounting plane 21 side of carriage 20 and small column hollow 47 on the top end side of screw shaft portion 41. The diameter of large column hollow 46 is larger than that of small column hollow 47, and large column hollow 46 and small column hollow 47 are coaxially arranged. Either diameters of large column hollow 46 and small column hollow 47 are larger than the diameter of screw shaft portion 41, and there is provided clearance between screw shaft portion 41 and the inside circumferential surface of adjusting member 43. And, adjusting member 43 is arranged transferable along the center line direction of screw shaft portion 41. The outer circumferential surface of adjusting member 43 is line contacted with side surface 12 of recording head 10.

Coil spring 42, which is attached winding around screw shaft portion 41, is arranged in large column hollow 46 in a state of contacting with the inner circumferential surface of adjusting member 43. The winding diameter of coil spring 42 is larger than the diameter of small column hollow 47, the end of the −Z direction side of coil spring 42 is pressing contacted with the wall surface of the −Z direction side of large column hollow 46, and the end of the +Z direction side of coil spring 42 is pressing contacted with the mounting plane 21 of carriage 20. The free length of coil spring 42 along the ±Z direction is longer than the length along the ±Z direction of large column hollow 46.

Nut 44 is engaged with screw shaft portion 41 at the top edge side, above adjusting member 43, of screw shaft portion 41 (at the −Z direction side of adjusting member 43). This nut 44 is another body from adjusting member 43 and is pressing contacted with the edge of the −Z direction side of adjusting member 43.

In the −X direction side than screw shaft portion 41, receiving portion 48 provided with inclined plane 45 is formed as one body with carriage 20. This receiving portion 48 is arranged on mounting plane 21 of carriage 20 so as to extrude toward the −Z direction. The normal line of inclined plane 45 on the +X direction side of receiving portion 48 obliquely crosses with the normal line of side surface 12 of recording head 10 and inclined plane 45 is inclined against side surface 12 of recording head 10. Further, inclined plane 45 is formed so as to be inclined against mounting plane 21 of carriage 20, and obliquely crosses with the ±Z direction (the center line direction of screw shaft portion 41). Inclined plane 45 being inclined in such a manner provides the shorter distance to the center line of screw shaft potion 41 as approaching to mounting plane 21 of carriage 20, while provides the longer distance to the center line of screw shaft potion 41 as leaving from mounting plane 21 of carriage 20.

Inclined plane 45 is point contacted with the outer circumference of adjusting member 43 at the edge portion on the +Z direction side of adjusting member 43. Further, screw shaft portion 41 is arranged between inclined plane 45 and side surface 12 of recording head 10, viewing toward the +Z direction.

Next, Y direction position adjusting structure 50 in an embodiment, to which a recording head position adjusting structure according to this invention is applied, will be explained. This Y direction position adjusting structure 50 adjusts the position of recording head 10 along the ±Y direction by transferring recording head 10 along the ±Y direction.

Y direction position adjusting structure 50 is constituted of screw shaft portion 51, which is provided on mounting plane 21 in a state of parallel to surfaces 14*a* and 14*b* of recording head 10 and standing against mounting plane 21 of carriage 20, coil spring 52 which is arranged winding around screw shaft portion 51, adjusting member 53 which is formed in a cylindrical form, storing coil spring 52 in the hollow, being inserted with screw shaft portion 51 with clearance, and is line contacted against surfaces 14*a* and 14*b* of recording head 10 with their circumferential surfaces, inclined planes 55*a* and 55*b* which is provided on mounting plane 21 of carriage 20 being inclined against mounting plane 21 of carriage 20 and contact with the edge of adjusting member 53, and nut 54 engaged with screw shaft portion 51 on the opposite side to inclined planes 55*a* and 55*b* relative to adjusting member 53.

Screw shaft portion 51 is constituted as one body with carriage 20 at the −Y direction side of surfaces 14*a* and 14*b* of recording head 10. This screw shaft portion 51 is arranged parallel to screw shaft portion 41 of X direction position adjusting structure 40 and perpendicular to mounting plane 21 of carriage 20. Screw groove 51*a* is provided on the outer circumferential surface of screw shaft portion 51 to form a bolt.

The winding diameter of coil spring 52 which is attached winding around this screw shaft portion 51 is set to be larger than the diameter of screw shaft portion 51 to make clearance between coil spring 52 and screw shaft portion 51. And coil spring 52 is fixed to neither screw shaft portion 51 nor carriage 20.

Further, screw shaft portion 51 is inserted into the hollow of adjusting member 53. Adjusting member 53 is formed so as to make the outside edge shape along the plane parallel to mounting plane 21 of carriage 20 to be circular, and further formed as a cylindrical form so as to make the ring-shaped cross section perpendicular to the center line of screw shaft 51. The hollow of adjusting member 53 is constituted of large column hollow 56 on mounting plane 21 side of carriage 20 and small column hollow 57 on the top end side of screw shaft portion 51. The diameter of large column hollow 56 is larger than that of small column hollow 57, and large column hollow 56 and small column hollow 57 are coaxially arranged. Either diameters of large column hollow 56 and small column hollow 57 are larger than the diameter of screw shaft portion 51, and there is provided clearance between screw shaft portion 51 and the inside circumferential surface of adjusting member 53. And, adjusting member 53 is arranged transferable along the center line direction of screw shaft portion 51. The outer circumferential surface of adjusting member 53 is line contacted with surfaces 14*a* and 14*b* of recording head 10.

Coil spring 52 is arranged winding around screw shaft portion 51 in large column hollow 56 in a state of being press contacted with the inner circumferential surface of adjusting member 53. Further, the winding diameter of coil spring 52 is larger than the diameter of small column hollow 57. The end of the −Z direction side of coil spring 52 is press contacted with the wall surface of the −Z direction side of large column hollow 56, and the end of the +Z direction side of coil spring 52 is press contacted with the mounting plane 21 of carriage 20. The free length of coil spring 52 along the ±Z direction is longer than the length of large column hollow 56 along the ±Z direction.

Nut 54 is engaged with screw shaft portion 51 at the −Z direction side than adjusting member 53. This nut 54 is another body from adjusting member 53 and pressing contacted with the edge of the −Z direction side of adjusting member 53.

In the −Y direction side than screw shaft portion 51, receiving portion 58 provided with inclined planes 55*a* and 55*b* is formed as one body with carriage 20. This receiving portion 58 is arranged so as to extrude toward the −Z direction on mounting plane 21 of carriage 20. When receiving portion 58 is viewed toward the +Z direction, V shaped cut 59 is formed at the +Y direction edge of receiving portion 58. The both side surfaces of cut 14 are inclined planes 55*a* and 55*b*.

Inclined planes 55*a* and 55*b* are formed being inclined against mounting plane 21 of carriage 20, and obliquely cross with the ±Z direction (the center line direction of screw shaft portion 51). Inclined planes 55*a* and 55*b* are inclined so that the distance to the center line of screw shaft portion 51 becomes shorter as approaching to mounting plane 21 of carriage 20, while the distance to the center line of screw shaft portion 41 becomes longer as leaving from mounting plane 21 of carriage 20. The normal lines of either planes 55*a* and 55*b* are obliquely cross with the normal line of surface 14*a* and the normal line of surface 14*b*, of recording head 10, and inclined planes 55*a* and 55*b* are inclined against surfaces 14*a* and 14*b* of recording head 10.

Inclined planes 55*a* and 55*b* are point contacted with outer circumference of adjusting member 53. Further, screw shaft portion 51 is arranged between inclined planes 55*a* and 55*b*, and surfaces 14*a* and 14*b* of recording head 10, as viewed toward the ±Z direction.

Next, a method to adjust the position of recording head 10 by utilizing X direction position adjusting structure 40 and Y direction position adjusting structure 50 will be explained.

First, when a user loosens screws 23 and 24, recording head 10 is made to be transferable against carriage 20.

Next, when a user rotates nut 44 to be approached to mounting plane 21 of carriage 20, adjusting member 43 is pushed by nut 44 also to approach mounting plane 21 of carriage 20. Herein, since inclined plane 45, which is point contacted with the edge on the +Z direction side of adjusting member 43, is fixed against carriage 20, but adjusting member is not fixed against screw shaft portion 41; adjusting member 43 is transferred toward the +X direction when adjusting member 43 approaches mounting plane 21 of carriage 20. Recording head 10 is pushed by adjusting member 43 to be transferred toward the +X direction according to transfer of adjusting member 43 toward the +X direction. Herein, coil spring 42 is pushed by adjusting member 43 to be compressed when adjusting member 43 approaches to mounting plane 21 of carriage 20.

On the other hand, when a user rotates nut 44 to the reverse direction to be detached from mounting plane 21 of carriage 20, adjusting member 43 is detached from mounting plane of carriage 20 by forcing power of coil spring 42. The edge portion on the +Z direction side of adjusting member 43 detaches from inclined plane 45 when adjusting member 43 detaches from mounting plane 21 of carriage 20, which enables recording head being transferable toward the −X direction. Therefore, recording head 10 is transferred toward the −X direction.

Herein, on the side opposite to receiving portion 48 with respect to recording head 10, a plate spring as a forcing means, which is pressing contacted with side surface 16 of recording head 10 and forces recording head 10 toward the −Z direction, may be fixed to carriage 20. When carriage 20 is equipped with such a plate spring, recording head 10 is transferred toward the −X direction by forced power of the plate spring by rotation of nut 44 by a user so as to detach the nut 44 from mounting plane 21 of carriage 20.

In the above manner, the position of recording head 10 along the ±X direction is determined by rotation of nut 44 by a user.

Next, when a user rotates nut 54 to one direction to be approached to mounting plane 21 of carriage 20, adjusting member 53 also approaches to mounting plane 21 of carriage-20 resisting against forced power of coil spring 52, resulting in transfer of adjusting member 53 toward the +Y direction by the inclination of inclined plane 55*a* and 55*b*. As a result of transfer of adjusting member 53 toward the +Y direction, recording head 10 is pushed by adjusting member 53 to be transferred toward +Y direction. When a user rotates nut 54 to the reverse direction, adjusting member 53 detaches from mounting plane 21 of carriage 20 to detach the edge portion of adjusting member 53 on the +Z direction side from inclined planes 55*a* and 55*b*. And recording head 10 is transferred toward the −Y direction.

Herein, on the +Y direction side than recording head 10, a plate spring as a forcing means, which is pressing contacted with the +Y direction edge portion of recording head and forces recording head 10 toward the −Y direction, may be fixed to carriage 20. When carriage 20 is equipped with such a plate spring, recording head 10 is transferred toward the −Y direction by forced power of the plate spring by rotation of nut 54 by a user so as to detach the nut 54 from mounting plane 21 of carriage 20.

In the above manner, the position of recording head 10 along the ±Y direction is determined by rotation of nut 54 by a user.

After the positions of the ±X direction and ±Y direction have been determined, a user tightens screws 23 and 24 to fix recording head 10 against carriage 20.

Herein, in the case that forced power of a plate spring as a forcing means works on inclined planes 45, 55*a* and 55*b* via recording head 10 and recording head 10 is fixed as a result of balancing repulsive power and forced power on inclined planes 45*a*, 55*a* and 55*b*, recording head is not necessarily fixed to carriage 20 by screws 23 and 24.

When adjusting member 43 is replaced by one having a larger outer diameter, recording head 10 can be positioned at further the +X direction side than the position of recording head 10 utilizing adjusting member 43, and when adjusting member 43 is replaced by one having a smaller outer diameter, recording head 10 can be positioned at further the −X direction side than the position of recording head 10 utilizing adjusting member 43. Similarly, by replacing adjusting member 53 with one having a different outer diameter, recording head 10 can be positioned further the ±Y direction side than the position of recording head 10 utilizing adjusting member 43.

As described above, according to an embodiment of this invention, since inclined plane 45, 55*a* and 55*b* are provided not on recording head 10 but on carriage 20, it is not necessary any more to precisely design recording head 10. Further, since inclined plane 45, 55*a* and 55*b* are provided on carriage 20 which is not a replaceable part, it is not necessary to confirm dimensional errors whenever recording head is replaced provided that dimensional errors of inclined plane 45, 55*a* and 55*b* have been once confirmed.

Since adjusting members 43 and 53 are arranged as a cylindrical form, adjusting member 43 keeps the state of contacting with the both of inclined plane 45 and side surface 12 of recording head 10 even when adjusting member 43 rotates around the center line, and adjusting member 53 keep contact with either of inclined planes 55*a* and 55*b* in addition to surfaces 14*a* and 14*b* of recording head 10 even when adjusting member 53 rotates around the center line.

Herein, this invention is not limited to the above embodiment and various improvements and changes of design may be made within a range not deviating from the view of this invention.

For example, adjusting members 43 and 53 are a cylindrical member, a cross section of which crossing the center line at right angles is a ring form, in the above embodiment, however, the cross section shape is not limited to a ring form. And it is preferable to utilize a tubular form member, a cross section of which perpendicular to the center line has a uniform size and shape along the center line and the outer circumferential surface of which is plane contacted or line contacted with surfaces 12, 14*a* and 14*b* of recording head 10, instead of adjusting members 43 and 53. For example, utilized may be a tubular form member, a cross section of which perpendicular to the center line is a triangle, a square or a polygon provided with more corners, instead of adjusting members 43 and 53.

Further, in the above embodiment, this invention is applied in the case of mounting recording head 10 on carriage 20 which is provided on the main body of a serial type inkjet printer, however, this invention may be applied in the case of mounting a line-head on a recording head mounting portion which is provided on the main body of a line-head type inkjet printer.

Embodiment 2

In the following, second embodiment of an inkjet printer according to this invention will be explained referring to the attached drawings.

Figure 5:
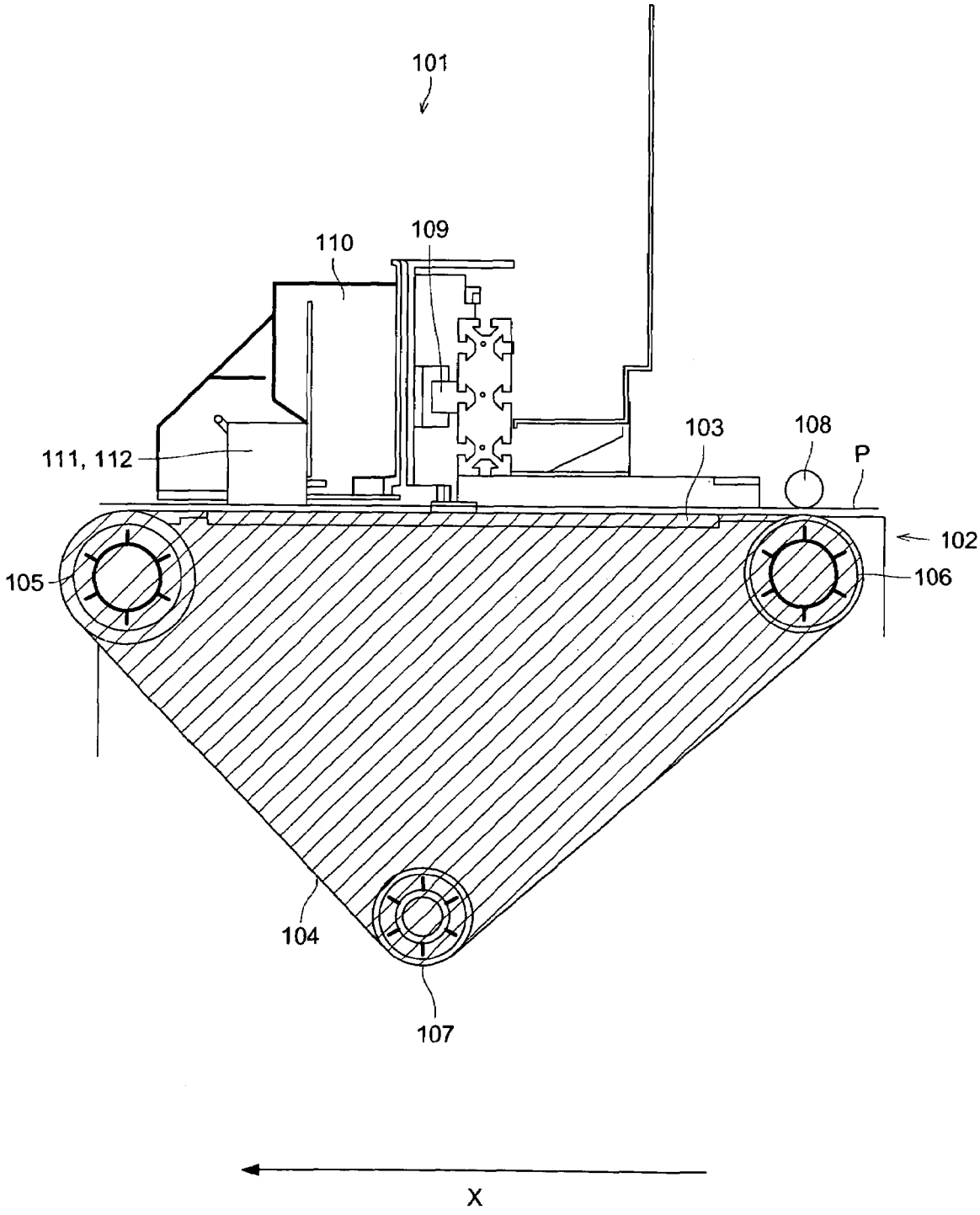
FIG. 5 is a side view drawing of a main portion schematically showing the brief constitution of an embodiment of an inkjet printer according to this invention.
Figure 6:
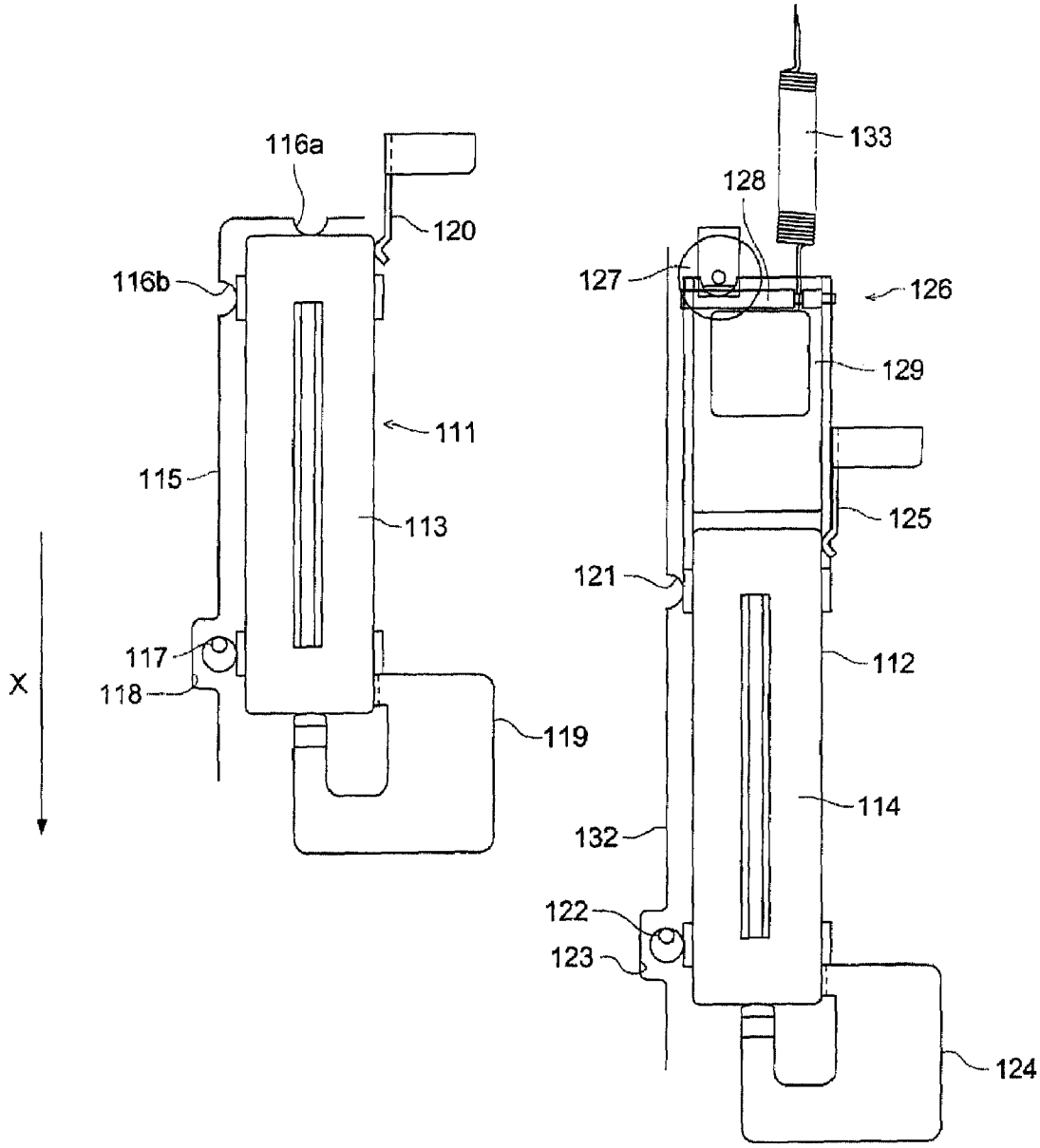
FIG. 6 is a base view drawing of a main portion schematically showing the state in which an upper stream recording head and a down stream recording head are supported by support members in an embodiment of an inkjet printer according to this invention.
Figure 7:
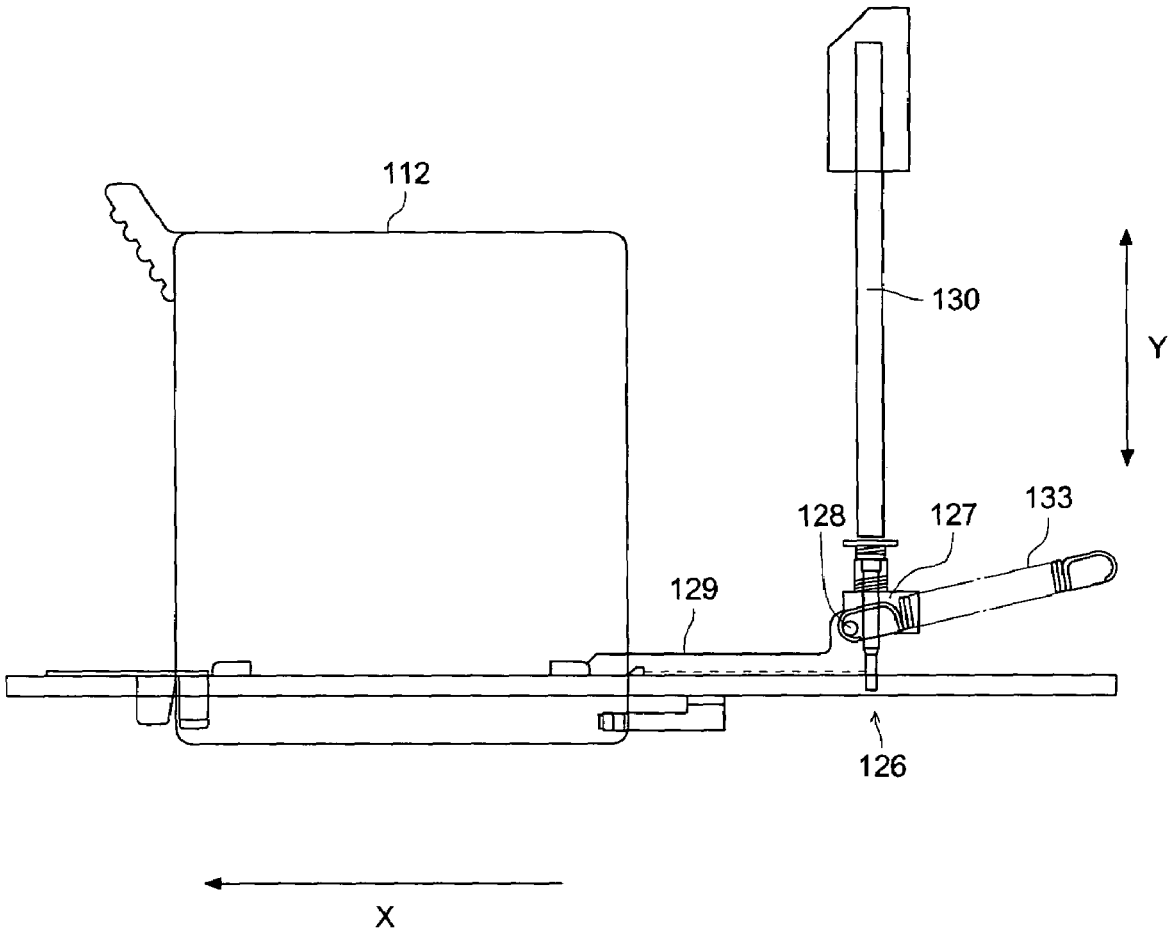
FIG. 7 is a side view drawing of a main portion schematically showing the brief structure of a down stream recording head and a recording head position adjusting mechanism in an embodiment of an inkjet printer according to this invention.

As shown in FIGS. 5-7, in this embodiment, an inkjet printer is a serial type inkjet printer 101, and inkjet printer 101 is equipped with transport unit 102 which transports recording medium P to a predetermined transport direction X.

Transport unit 102 is equipped with platen 103 which supports flat plane recording medium P formed from the non-recording surface, and a circular transporting belt 104, which supports recording medium P in a plane state and transports to the horizontal direction, is spreading arranged by drive roller 105 which rotationally operates transfer belt 104, dependent roller 106 which rotates depending on drive roller 105, and tension roller 107 which provide transporting belt 104 with a certain tension. Further, press roller 108 is provide at the position opposing to dependent roller 106 sandwiching transporting belt 104, which prevents recording medium P from floating up, so as to rotate depending on rotation of transfer belt 104. A drive motor, which is not shown in the drawing, is connected to drive roller 105, and dependent roller 106 rotates as drive motor is rotationally driven to transport transporting belt 104 while being applied with an appropriate tension by tension roller 107. In this manner, recording medium P is successively transported toward the predetermined transport direction X while being supported by dependent roller 106 and press roller 108.

Further, on the upper direction of platen 103 of transport unit 102, carriage rail 109 is arranged extending along the main scan direction crossing against transport direction X at right angles. On this carriage rail 109, carriage 110 is supported so as to be transferable freely back and forth along carriage rail 109, and this carriage 110 can be driven back and forth along the main scan direction by a drive mechanism which is not shown in the drawing.

Carriage 110 is provided with two sets of groups, each of which comprising four recording heads corresponding to each color (black (K), cyan (C), magenta (M) and yellow (Y)) utilized in inkjet printer 101 in this embodiment, and one set of them is mounted at the upper stream of the recording medium transport direction X while the other set is mounted at the down stream of recording medium transport direction X, so as to vary the positions each other. Each recording head is provided with an outer shape of a rectangular solid form, and arranged so as to make each longer direction parallel to the transport direction X. The surface of each recording head facing to recording medium P forms an ink ejecting surface provided with plural ejection outlets (being not shown in the drawing), and each recording head ejects each color ink from ink ejection outlet surfaces 113 and 114. Herein, ink utilized in inkjet printer 101 is not limited thereto, and for example, colors such as light yellow (LY), light magenta (LM) and light cyan (LC) can be also utilized. In this case, a recording head corresponding to each color is mounted on carriage 110.

Herein, with respect to at least recording heads 111 and 112 which eject the same color ink, out of recording heads 111 arranged at the upper stream side of the recording medium transport direction X (hereinafter, referred to as "upper stream recording heads") and recording heads 112 arranged at the down stream side (hereinafter, referred to as "down stream recording heads"), distance in the transport direction X between an ink ejection outlet out of ink ejection outlets of upper stream recording heads 111 arranged at the most down stream of the transport direction X and an ink ejection outlet out of ink ejection outlets of down stream recording heads 112 arranged at the uppermost stream of the transport direction X is set to coincide with the interval of ink ejection outlets of each recording head. Thereby, efficient image recording can be performed by upper stream recording head 111 and down stream recording head 112 similar to image recording by utilizing one long recording head.

As shown on the left side of FIG. 6, each upper stream recording head 111 is fixed against carriage 110 by first supporting members 115, as many as that of upper stream recording heads 111 of which are provided on the bottom plane of carriage 110, so as to make ink ejection surface 113 face to recording medium P. First supporting member 115 is arranged so as to face to one side surface of each upper stream recording head 111 and the surface positioned on the upper stream side of the recording medium transport direction X (hereinafter, referred to as "the back surface") and to surround each upper stream recording head 111, resulting in each upper stream recording head 111 being fixing supported from the two directions, one side surface side and the back surface side, by first supporting member 115, respectively. On first supporting member 115, provided are supporting projections 116*a* and 116*b*, at the position where said first support member is press contacted with the back surface of upper stream recording head 111 and the position where said first support member is press contacted with the side surface near the back surface of recording head 111, respectively. Further, eccentric cam 117 is provided between first supporting member 115 and upper stream recording head 111, and concave portion 118 is formed on first supporting member 115 to enable rotational movement of eccentric cam 117. Operation pin, which is not shown in the drawing, is provided on eccentric cam 117, and eccentric cam 117 rotates by rotating the operation pin to enable adjustment of the distance of upper stream recording head against first supporting member 115. Thereby, possible is adjustment of the inclination of upper stream recording head 111 in the transport direction X.

Further, first forcing member 119, which is press contacted to the surface opposing to the back surface of each upper stream recording head 111 (hereinafter referred to as "the front surface") and to the side surface not supported by first supporting member 115 and forcing presses upper stream recording head 111 toward the first support member 115 side from the front surface and one side surface, and second forcing member 120, which is press contacted with the side surface not supported by first supporting member 115 of each upper stream recording head 111 and presses each upper stream recording head 111 from the side surface side, are provided on carriage 10. Upper stream recording head 111 is always forced against first supporting member 115 by this first forcing member 119 and second forcing member 120 resulting in fixing the position of upper stream recording head 111 at a predetermined position.

On the other hand, as shown on the right side of FIG. 6 and in FIG. 5, each down stream recording head 112 is fixed against carriage 110 by second supporting members 132, as many as that of down stream recording heads 112 of which is provided on the bottom plane of carriage 110, so as to make ink ejection surface 114 face to recording medium P. Second supporting member 132 is arranged so as to face to one side surface of each down stream recording head 112 and each down stream recording head 112 are fixed by second supporting member 132 from one side surface. On second supporting member 132, provided is supporting projection 121 to support down stream recording head 112 at the position where said second supporting member is press contacted with the surface near to the upper stream side of the recording medium transport direction X (hereinafter referred to as "the back surface"). Further, eccentric cam 122 is provided between second supporting member 132 and down stream recording head 112, and concave portion 123 is formed on second supporting member 132 to enable rotational movement of eccentric cam 122. Operation pin, which is not shown in the drawing, is provided on eccentric cam 122, and eccentric cam 122 rotates by rotating the operation pin, which enables adjusting the distance of down stream recording head 112 against second supporting member 132. As a result, it becomes possible to adjust the inclination of down stream recording head 112 in the transport direction X.

Further, first forcing member 124, which is press contacted to the surface opposing to the back surface of each down stream recording head 112 (hereinafter referred to as "the front surface") and to the side surface not supported by second support member 132 and forcing presses down stream recording head 112 toward second support member 132 side from the front surface and one side surface, and second forcing member 125, which is press contacted with the side surface not supported by second support member 132 of each down stream recording head 112 and forcing presses down stream recording head 112 from the side surface side, are provided on carriage 110. Down stream recording head 112 is always forced against second supporting member 132 by this first forcing member 124 and second forcing member 125 resulting in fixing the position of down stream recording head 112 at a predetermined position.

Figure 8:
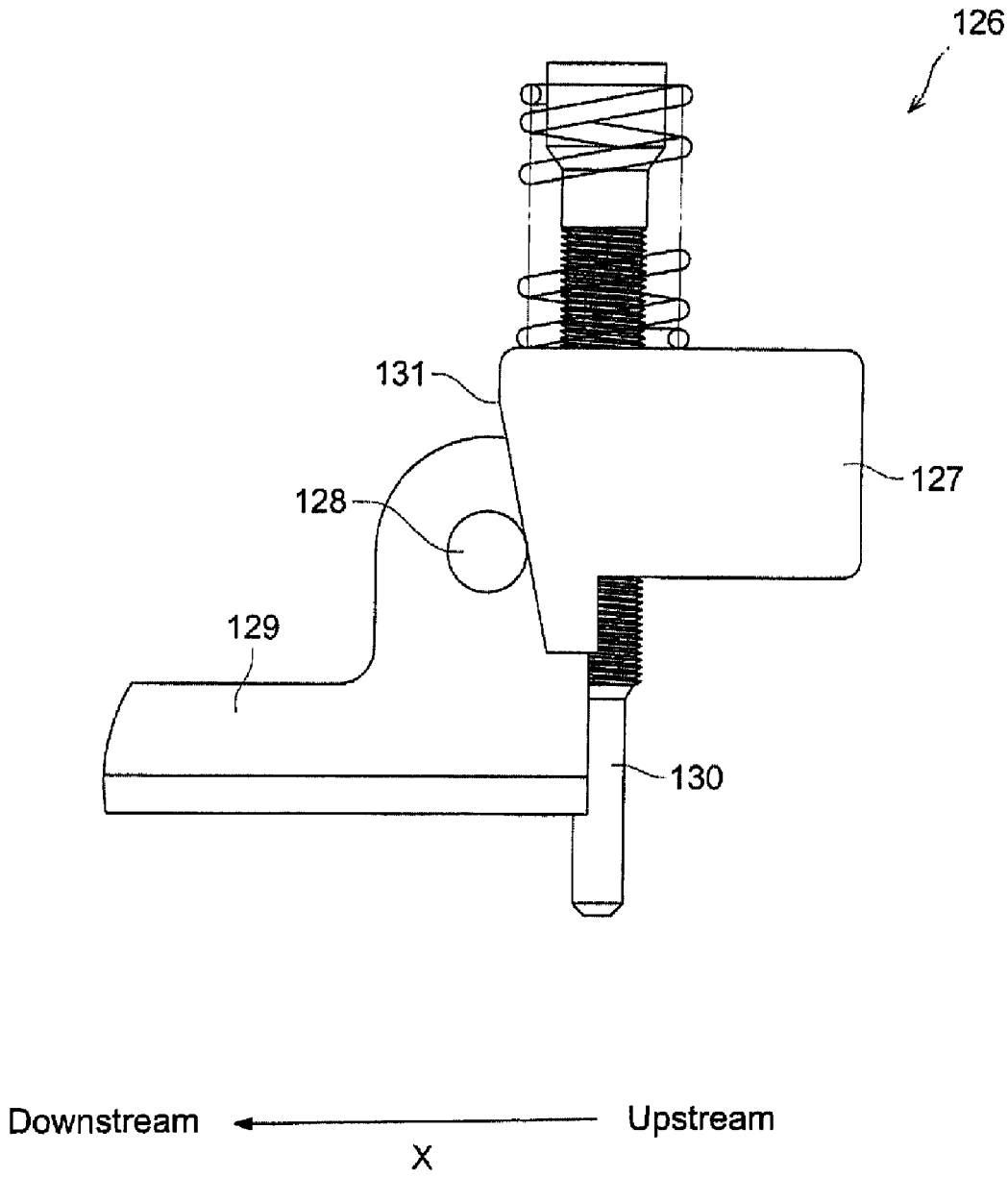
FIG. 8 is a magnified side view drawing of a adjusting member and a butting member of a head position adjusting mechanism in an embodiment of an inkjet printer according to this invention.

Further, carriage 110 is provided with head position adjusting mechanism 126, which adjusts the position of down stream recording head 112 in the transport direction X, at the position corresponding to the back surface of down stream recording head 112. As shown in FIG. 8, head position adjusting mechanism 126 is equipped with adjusting member 127 which constitutes a cam mechanism to be a main portion and butting member 129 provided with pin member 128 which functions as a depending portion to receive motion in the vertical direction Y of adjusting member 127 in FIG. 7 and to convert this motion into movement in the transport direction X.

Adjusting member 127 is attached with operation shaft 130, the outer circumference of which is provided with a screw groove, in the vertical direction Y crossing the upper surface of carriage 110 at right angles. Further, adjusting member 127 is penetrated by a screw hole, the inside of which is provided with a screw groove. The screw groove of operation shaft 130 and the screw groove of adjusting member 127 are made to be engaged. Adjusting member 127 is pushed downward by rotation of operation shaft 130.

Further, the one side surface of adjusting member 127 facing upward to downward along the Y direction perpendicular to the transport direction X, forms inclined plane 131 which, from a top of the adjusting member 127, is inclined towards the upper stream side of the transport direction X. Pin member 128 is fixed at the one end of butting member 129, and inclined plane 131 of adjusting member 127 is press contacted to pin member 128. Further, pin member 128 is press contacted against inclined plane 131 of adjusting member 127 by forcing spring 133. The other end of butting member 129 makes a butting portion to be contacted to the back surface of down stream recording head 112, so as to press down stream recording head 112 toward the transfer direction from the back surface side. Thereby, when adjusting member 127 is descended, this movement in the vertical direction Y is converted to movement in the transfer direction X along with being transmitted to pin member 128 which is press contacted to inclined surface 131 of adjusting member 127, so that butting member 129 fixed on pin member 128 presses the back surface of down stream recording head 112 toward the transport direction X.

Next, function of inkjet printer 101 in this embodiment will be explained.

First, upper stream recording head 111 is mounted on each first support member 115 of carriage 110 and the inclination in the transport direction X of each upper stream recording head 111 is adjusted by rotating the operation pin of eccentric cam 117. The position of each upper stream recording head 111 is determined by being forced against first support member 115, by first forcing member 119 and second forcing member 120, respectively.

Next, down stream recording head 112 is mounted on each second support member 132 of carriage 110 and the inclination in the transport direction X of each down stream recording head 112 is adjusted by rotating the operation pin of eccentric cam 122.

Further, in the case that there is a recording head the position of which deviates in the transport direction X among down stream recording heads 112 from corresponding recording head 111, which ejects the corresponding same color, among upper recording heads 111, the position adjustment of this down stream recording head 112 in the transport direction X is performed by rotating operation shaft 130 provided on second support member 132 of this down stream recording head. That is, for example, when down stream recording head 112 is deviated toward upper stream side in the transport direction X with respect to the position relation with upper stream recording head 111, adjusting member 127 is descended along the vertical direction Y by rotating operation shaft 130 to a predetermined direction. The movement of adjusting member 127 in the vertical direction Y converted to the movement in the transport direction X by pin member 128, which is press contacted with inclined plane 131 of adjusting member 127, being pushed out toward the transport direction X along inclined plane 131, and thereby butting member 129 is transferred toward the transport direction to press down stream recording head 112 toward the transport direction X, resulting in adjustment of the position.

On the contrary, in the case that down stream recording head 112 is deviated toward the down stream side in the transport direction X with respect to the position relation with upper stream recording head 111, adjusting member 127 is ascended along the vertical direction Y by rotating operation shaft 130 to the reverse direction. At this time, since pin member 128 which is press contacted to inclined plane 131 of adjusting member 127 is forced by forcing spring 133 toward the upper stream side of the transport direction, pin member 128 and butting member 129 being press contacted with this are transferred toward the direction opposite to transport direction X. Further, the position of each down stream recording head is determined by being forced against second support member 132, by first forcing member 124 and second forcing member 125, respectively.

In this manner, the distance between an ink ejection outlet which is positioned at the most down stream in the transport direction X among ink ejection outlets of upper stream recording heads 111 and an ink ejection outlet which is positioned at the most upper stream in the transport direction X among ink ejection outlets of down stream recording heads 112 is adjusted so as to coincide with an interval of ink ejection outlets of each recording head, in addition that the inclinations in the transport direction X of all down stream recording heads 112 and upper stream recording heads 111 are adjusted, resulting in that each recording heads 111 and 112 is in a state appropriate for image recording.

Then, when image recording starts, recording medium P is transported toward the transport direction according to rotation of drive roll 105, and carriage 110 is transferred back and forth along the main scan direction synchronous with transport of recording medium P. At this time, ink of each color of Y, M, C and K lands on the image recording surface of recording medium P by ejection of each ink as minute liquid droplets toward the image recording surface of recording medium P from each upper stream recording head 111 and down recording head 112 which are mounted on carriage 110.

Thereafter, inkjet printer 101 repeats the above-described each movement resulting in successive recording of a desired image comprising plural dots of each color on the image recording surface of recording medium P.

As in the above manner, according to inkjet printer 101 of this embodiment, since the position along the transport direction X of down stream recording head 112 is determined by position adjusting mechanism 126 while each upper stream recording head 111 and down stream recording head 112 are pressed by each first support member 115 and each second support member 132 after the inclination of each upper stream recording head 111 and down stream recording head 112 in the transport direction is once positioned, the inclination having been positioned before never deviates at the time of position adjustment in the transport direction and repeated fine adjustment is not required.

Further, since the position of down stream recording head 111 is adjusted not by directly press contacting a screw to the recording head but by pressing a butting member utilizing inclined plane 131 of adjusting member 127, the position of down stream recording head 111 can be finely adjusted non-stepwise not being affected by the size of a screw groove. As a result, it is possible to surely land ink ejected from each recording head at the accurate landing position, resulting in formation of high quality images without such as color doubling.

Further, since recording heads which eject ink of the same color are arranged on the upper stream side and the down stream side of carriage 110 respectively, high speed image recording operation is possible. Further, in the case of a plural number of recording heads are provided for one color in this manner, image quality may be deteriorated such as causing deep and light colored portions in a recorded image by deviation of the position of the recording heads which eject the same color, however, high speed image recording while keeping high precision image quality is possible due to adjustment of the position of recording heads along the transport direction.

Herein, in this embodiment, head position adjusting mechanism 126 is arranged for every down stream recording head 112 which is arranged on down stream side among recording heads mounted on carriage 110; however, it may be arranged only for a part of them.

Further, in this embodiment, head position adjusting mechanism 126, which adjusts the position in the transport direction, is arranged for down stream recording heads 112 which are arranged on down stream side, among recording heads mounted on carriage 110; however, head position adjusting mechanism 126 may be arranged on second support member 132 to adjust the position of upper stream recording head 111 which is arranged on upper stream side. Further, head position adjusting mechanism 126 may be arranged for all of upper recording heads 111 and down stream recording heads 112.

In addition, in this embodiment, head position adjusting mechanism 126 is a cam mechanism comprising adjusting member 127 provided with inclined plane 131 and pin member 128 which convert the motion of adjusting member 127 in the vertical direction to the motion in the transfer direction; however, head adjusting member 126 is not limited thereto and applicable is a mechanism provided that being able to convert the motion along the vertical direction of such as a screw into that along the direction crossing at right angles therewith to finely adjust the position of recording head non-stepwise.

Furthermore, this invention can be also applied for a line mode inkjet printer to perform fine adjustment of the position between recording heads. In this case, for example, head position adjusting mechanism 126 is provided at the edge of each recording head to adjust each recording head position and to correct the position deviations.

Herein, in an inkjet printer of this invention, two recording heads for each color are provided, however, the number of recording heads for each color is not limited thereto and a furthermore plural number of them may be provided. In this case, any one of recording heads for each color is supported by first support member 115 and the other recording heads are supported by second support member 132, so that each recording head position adjustment is performed by head position adjustment mechanism 126. In addition, head position adjustment mechanism 126 may be provided for every recording head.

Further, recording head utilized in inkjet printer 101 according to this invention may be either of an on-demand mode or a continuous mode. Further, an ink ejection mode includes, for example, an electromechanical conversion mode (such as a single cavity type, a double cavity type, a vendor type, a piston type, a share mode type and a shared-wall type), an electro-thermal conversion mode (such as a thermal inkjet type and a bubble jet (a registered mark) type), an electrostatic suction mode (such as an electric field control type and a slit jet type) and a discharge mode (such as a spark jet type), and any ejection mode may be employed.

Further, as recording medium P, applied can be those comprising various types of materials such as various types of paper like plain paper, reproduced paper and glossy paper, various types of cloth, various types of non-woven cloth, metal and glass. And, as the form of recording medium P, applied can be various forms such as a roll form in addition to a cut sheet form and a plate form.

Further, in this embodiment, ink curable without light irradiation is utilized, however, ink is not limited thereto and image recording may be performed, for example, by use of ultraviolet ray curable type ink which cures by ultraviolet ray irradiation. Ultraviolet ray curable ink is briefly classified into a radical polymerization type ink which contains radical polymerizing compounds, as such as a polymerizing monomer and a photopolymerization initiator, and a cationic polymerization type ink containing cationic polymerizing compounds; and the both types of ink can be applied as ink utilized in this first embodiment, as well as a hybrid type ink, in which a radical polymerizing type ink and a cationic polymerizing ink are combined, may be also applied as ink utilized in this embodiment. In the case of utilizing ultraviolet ray curable ink, it is necessary to arrange a ultraviolet ray irradiation device equipped with a ultraviolet ray source on the down stream side than recording head 131 in the recording medium transport direction X, and as this ultraviolet ray source, applied can be, such as a high pressure mercury lamp, a low pressure mercury lamp, a metal halide lamp, a semiconductor laser, a cold cathode tube, an excimer lamp and a LED (Light Emitting Diode). Ink curable with irradiation of electromagnetic waves such as electron rays, X rays, visible light and infrared rays may be also applied. In this case, applied are a polymerizing compound which is curable by polymerization with light other than ultraviolet rays, and a photo-initiator which initiates polymerization reaction between the polymerizing compounds each other with light other than ultraviolet rays.

In addition, this invention is not limited to the above-described embodiments and can be naturally changeable.

As can be understood from the above-described embodiments, the prevent invention includes the following configurations:

(1) A position adjusting structure for adjusting a position of a recording head with respect to a recording head mounting portion of a printer main body, the position adjusting structure including: a head mounting plane arranged on the recording head mounting portion; an adjusting member, which is transferable along a direction substantially perpendicular to the head mounting plane; and an inclined flat plane, which is arranged on either one of the recording head mounting portion or the adjusting member and is inclined against the head mounting plane;

wherein, the adjusting member transfers the position of the recording head with respect to the recording head mounting portion according with transfer of the adjusting member.

(2) The position adjusting structure described in item (1), wherein the inclined flat plane is arranged on the recording head mounting portion with inclined state against the head mounting plane, the inclined flat plane being inclined against a plane provided on the recording head, wherein the adjusting member contacts with the plane provided on the recording head and with the inclined flat plane.

In the invention described in items (1) and (2), since an inclined plane provided on a recording head mounting portion is inclined against the plane of a recording head and an adjusting member is brought in contact with the plane of a recording head and the inclined plane, a recording head is pushed by the adjusting member when the adjusting member is transferred toward the crossing portion of the extended plane of the inclined plane and the extended plane of the recording head plane. Therefore, a recording head can be transferred along the mounting plane of a recording head mounting portion toward the direction leaving from the inclined plane. While, the adjusting member leaves from the recording head plane when an adjusting member is transferred to leave from the crossing portion of the extended plane of the inclined plane and the extended plane of the recording head plane. Therefore, a recording head can be transferred along the mounting plane of a recording head mounting portion toward the direction approaching the inclined plane by transferring a recording head so as to be brought in contact with both the inclined plane and the recording head.

Further, since an inclined plane is provided on a recording head mounting portion, the recording head plane is not required to be provided with an inclined plane. Therefore, precise design of a recording head is not required. In addition, since an inclined plane is provided on a recording head mounting portion of a printer main body which is not a replaceable part, there required no confirmation of dimensional errors as often as replacing the recording head, after dimensional errors of the inclined plane have been once confirmed.

Herein, a plane provided on a recording head may be either the outer surface of the recording head itself or the surface of a member attached to this recording head surface.

(3) The recording head position adjusting structure of item (2), wherein the plane provided on the recording head is arranged perpendicular to the head mounting plane of the recording head mounting portion.

wherein the aforesaid a recording head plane is arranged perpendicular against the mounting plane of the aforesaid recording head mounting portion.

(4) The recording head position adjusting structure of item (2) or (3), wherein the adjusting member has a circular outer circumferential shape in a cross-sectional plane parallel to the head mounting plane of the recording head mounting portion.

In item (4), since the outer circumferential shape of the aforesaid adjusting member, along the plane parallel to the mounting plane of the aforesaid recording head mounting portion, is circular, the adjusting member is kept in contact with the inclined plane and the recording head plane even when the adjusting member rotates around the center line perpendicular to the mounting plane.

(5) The recording head position adjusting structure described in any one of items (2)-(4), further provided with a shaft, which is stood against the head mounting plane, between the inclined flat plane and the plane provided on the recording head, wherein the shaft is inserted into the adjusting member so that the adjusting member is transferable along the shaft.

In item (5), since a shaft portion between the aforesaid inclined plane and the aforesaid recording head plane is arranged standing against the mounting plane of the aforesaid recording head mounting portion, the adjusting member can be brought in contact and detached against the crossing portion of the extended plane of the inclined plane and the extended plane of the recording head plane by transferring the adjusting member along the shaft portion. Therefore, a recording head can be brought in contact and detached against the inclined plane along the mounting plane of a recording head mounting portion by transferring the adjusting member along the shaft portion.

(6) The recording head position adjusting structure described in item (5), wherein the aforesaid shaft portion is arranged parallel to the aforesaid recording head plane.

In item (6), since a shaft portion is arranged parallel to a recording head plane, an adjusting member can be transferred along the shaft portion while being kept in contact with the recording head plane.

(7) The recording head position adjusting structure described in item (5) or (6), wherein the aforesaid shaft portion is arranged perpendicular to the mounting plane of the aforesaid recording head mounting portion.

(8) The recording head position adjusting structure described in any one of items (5)-(7), wherein the aforesaid shaft portion is fixed to the aforesaid recording head mounting portion and the aforesaid shaft portion is inserted into the aforesaid adjusting member with clearance.

In item (8), since an shaft portion is fixed to a recording head mounting portion but the shaft portion is inserted into the adjusting member with clearance, the adjusting member can be brought in contact with the inclined plane and the recording head plane even when the adjusting member is transferred along the shaft portion.

(9) The recording head position adjusting structure described in any one of items (5)-(8), wherein the adjusting member has a cylindrical form so as to make a ring shape in a cross-sectional plane perpendicular to the shaft, the shaft being inserted into a hollow of the adjusting member with clearance, and an outer circumferential surface of the adjusting member is brought in contact with the plane provided on the recording head.

In item (9), since a shaft portion is inserted into the hollow of an adjusting member with clearance, the adjusting member can be kept in contact with the contact plane even when the adjusting member is transferred along the shaft portion.

(10) The recording head position adjusting structure described in item (9), wherein the inclined flat plane contacts with an end portion in a central axis direction of the adjusting member.

In item (10), since an adjusting member contacts with an inclined plane and is inserted into a hollow of the adjusting member with clearance, a recording head is pushed by the adjusting member when the adjusting member is transferred along the center line direction toward the inclined plane side, which enables to transfer the recording head toward the direction leaving from the center line of the shaft portion.

(11) The recording head position adjusting structure described in item (10), further comprising a nut, which is engaged with the shaft, at an opposite end side of the adjusting member to the end portion contacting the inclined flat plane.

In item (11), a nut is transferred along a shaft portion by rotating the nut around the shaft portion, which enables to transfer the adjusting member along the shaft portion in accordance with transfer of the nut.

(12) The recording head position adjusting structure described in item (10) or (11), wherein a coil spring, which is installed winding the aforesaid shaft portion and stored in the hollow of the aforesaid adjusting member, is further provided, and one end portion of said coil spring, being arranged along the center line direction of said adjusting member, pressing contacts with the hollow wall of said adjusting member, while the other end portion of said coil spring, being arranged along the center line direction of said adjusting member, pressing contacts with the mounting plane of the aforesaid recording head mounting portion.

In item (12), an adjusting member can be transferred along a shaft portion toward the direction leaving a recording head mounting portion by a forced power of a compressed coil spring.

(13) An inkjet printer including: a recording head to eject ink on a recording medium; and the position adjusting structure of item (1).

(14) An inkjet printer including: a recording head to eject ink on a recording medium; and the position adjusting structure of item (2).

(15) The position adjusting structure of item (1), wherein the inclined flat plane is arranged on the adjusting member with inclined state against the head mounting plane, and the adjusting member contacts with a butting member provided on the recording head.

(17) An inkjet printer, which is equipped with a carriage, on which a recording head to eject ink on a recording medium is mounted, and performs image recording while transferring the carriage back and forth in a main scanning direction perpendicular to a transporting direction with transporting the recording medium in the transporting direction; the inkjet printer comprising a position adjusting structure for performing position adjustment of the recording head on the carriage along the transporting direction; wherein the position adjusting structure including:

an adjusting member, which has an inclined flat plane parallel to the main scanning direction and inclined against the transporting direction, being transferable in a direction perpendicular to the main scanning direction and to the transporting direction; a butting member which is press-contacted with the adjusting member and transferable in the transporting direction in accordance with transferring of the adjusting member; a supporting member to support the recording head on the carriage; and a biasing member to fix the recording head by pressing the recording head against the supporting member and the butting member.

According to item (17), a adjusting member of a head position adjusting structure transfers along up and down direction to transfer a butting member back and forth along the recording medium transfer direction, which enables minute adjustment of a recording head position in the transfer direction, in addition to this, the inclination of the recording head in the transfer direction does not deviate in the case of adjusting the position of a recording head along the transfer direction because the recording head is pressed against a supporting member.

(18) The inkjet printer described in item (17), wherein provided is a head inclination adjusting mechanism which performs adjustment of the inclination of the aforesaid recording head against the aforesaid transfer direction by changing the distance of the aforesaid recording head in the main scan direction relative to the aforesaid support member.

According to item (18), a head inclination adjusting mechanism enables adjustment of the inclination of the aforesaid recording head against the aforesaid transfer direction by changing the distance of the aforesaid recording head in the main scan direction relative to the aforesaid support member.

(19) The inkjet printer described in items (17) or (18), wherein a plural number of the aforesaid recording heads are mounted on the aforesaid carriage and the aforesaid head position adjusting mechanism is provided for at least one recording head among the aforesaid plural number of recording heads.

According to item (19), in the case of a plural number of the recording heads are mounted on a carriage, a head position adjusting mechanism is provided for at least one recording head among said plural number of recording heads to enable position adjustment of the recording head along the transfer direction.

(20) The inkjet printer described in item (19), wherein the aforesaid carriage is equipped with a plural number of the aforesaid recording heads for the same color ink.

According to item (20), since a plural number of recording heads for the same color ink are provided and position adjustment of the recording head along the transfer direction is possible, image formation is possible by utilizing a plural number of recording heads as if they were one long recording head.

What is claimed is:

1. A position adjusting structure which adjusts a position of a recording head with respect to a recording head mounting portion of a printer main body, the position adjusting structure comprising:

a head mounting plane arranged on the recording head mounting portion;

an adjusting member which is movable along a direction substantially perpendicular to the head mounting plane; and an inclined flat plane which is arranged on one of the recording head mounting portion and the adjusting member, and which is inclined with respect to the head mounting plane;

wherein each of the recording head mounting portion and the position adjusting structure is provided on the printer main body and not on the recording head;

wherein the adjusting member adjusts the position of the recording head with respect to the recording head mounting portion in accordance with movement of the adjusting member, and the adjusting member is in moving contact with the inclined flat plane.

2. An inkjet printer comprising:

a recording head to eject ink on a recording medium; and the position adjusting structure of claim 1.

3. The position adjusting structure of claim 1, wherein the inclined flat plane is arranged on the adjusting member inclined with respect to the head mounting plane, and the adjusting member contacts with a butting member which presses the recording head.

4. An inkjet printer comprising:

a recording head to eject ink on a recording medium; and the position adjusting structure of claim 3.

5. A position adjusting structure which adjusts a position of a recording head with respect to a recording head mounting portion of a printer main body, the position adjusting structure comprising:

a head mounting plane arranged on the recording head mounting portion;

an adjusting member which is movable along a direction substantially perpendicular to the head mounting plane; and an inclined flat plane which is arranged on one of the recording head mounting portion and the adjusting member, and which is inclined with respect to the head mounting plane;

wherein the adjusting member adjusts the position of the recording head with respect to the recording head mounting portion in accordance with movement of the adjusting member, and the adjusting member is in moving contact with the inclined flat plane; and wherein the inclined flat plane is arranged on the recording head mounting portion and is inclined with respect to the head mounting plane and with respect to a plane provided on the recording head, and wherein the adjusting member contacts with the plane provided on the recording head and with the inclined flat plane.

6. The position adjusting structure of claim 5, wherein the plane provided on the recording head is arranged perpendicular to the head mounting plane of the recording head mounting portion.

7. The position adjusting structure of claim 5, wherein the adjusting member has a circular outer circumferential shape in a cross-sectional plane parallel to the head mounting plane of the recording head mounting portion.

8. The position adjusting structure of claim 5, further comprising a shaft projecting from the head mounting plane, between the inclined flat plane and the plane provided on the recording head, wherein the shaft is inserted into the adjusting member so that the adjusting member is movable along the shaft.

9. The position adjusting structure of claim 8, wherein the shaft is arranged parallel to the plane provided on the recording head.

10. The position adjusting structure of claim 8, wherein the shaft is arranged perpendicular to the head mounting plane of the recording head mounting portion.

11. The position adjusting structure of claim 8, wherein the shaft is formed integrally with the recording head mounting portion, and the shaft is inserted into the adjusting member with a clearance.

12. The position adjusting structure of claim 8, wherein the adjusting member has a cylindrical form so as to make a ring shape in a cross-sectional plane perpendicular to the shaft, wherein the shaft is inserted into a hollow of the adjusting member with a clearance, and wherein an outer circumferential surface of the adjusting member is brought in contact with the plane provided on the recording head.

13. The position adjusting structure of claim 12, wherein the inclined flat plane contacts with a first end portion of the adjusting member in a central axis direction.

14. The position adjusting structure of claim 13, further comprising a nut, which is engaged with the shaft, towards a second end portion of the adjusting member, opposite to the first end portion which contacts the inclined flat plane.

15. The position adjusting structure of claim 13, further comprising a coil spring which winds around the shaft, and which is housed in the hollow of the adjusting member, wherein a first end portion of the coil spring, in the central axis direction press-contacts with a hollow wall of the adjusting member, and wherein a second end portion of the coil spring, in the central axis direction press-contacts with the head mounting plane of the recording head mounting portion.

16. An inkjet printer comprising:

a recording head to eject ink on a recording medium; and the position adjusting structure of claim 5.

17. An inkjet printer which is equipped with a carriage, on which a recording head to eject ink on a recording medium is mounted, and which performs image recording while transferring the carriage back and forth in a main scanning direction perpendicular to a transporting direction of the recording medium, wherein the inkjet printer comprises a position adjusting structure which performs position adjustment of the recording head on the carriage along the transporting direction, and wherein the position adjusting structure comprises:

an adjusting member having an inclined flat plane, which is parallel to the main scanning direction, and which is inclined with respect to the transporting direction, wherein the adjusting member is movable in a direction perpendicular to both the main scanning direction and the transporting direction;

a butting member which is press-contacted with the adjusting member, and which is movable in the transporting direction in accordance with movement of the adjusting member;

a supporting member to support the recording head on the carriage; and a biasing member to fix the recording head by pressing the recording head against the supporting member and the butting member.

18. The inkjet printer of claim 17, further comprising a head inclination adjusting mechanism which adjusts inclination of the recording head with respect to the transporting direction by changing a distance of the recording head in the main scan direction from the support member.

19. The inkjet printer of claim 17, wherein a plural number of recording heads are mounted on the carriage, and the position adjusting structure is provided for at least one of the plural number of recording heads.

20. The inkjet printer of claim 19, wherein the carriage is equipped with multiple recording heads for one and the same color ink.

* * * * *